US006405880B1

(12) United States Patent
Webb

(10) Patent No.: US 6,405,880 B1
(45) Date of Patent: Jun. 18, 2002

(54) RACK MERCHANDISING SYSTEM

(75) Inventor: Paul Hyten Webb, Alpharetta, GA (US)

(73) Assignee: RTC Industries, Inc., Rolling Meadows, IL (US)

( * ) Notice: Subject to any disclaimer, the term of this patent is extended or adjusted under 35 U.S.C. 154(b) by 0 days.

(21) Appl. No.: 09/897,622

(22) Filed: Jul. 2, 2001

(51) Int. Cl.[7] ..... A47F 5/00

(52) U.S. Cl. ..... 211/59.2; 211/187; 108/107; 108/55.1

(58) Field of Search ..... 211/187, 59.2, 211/186, 189, 90.02, 90.03, 90.04; 108/107, 108, 55.1, 51.11

(56) References Cited

U.S. PATENT DOCUMENTS

| | | | | |
|---|---|---|---|---|
| 2,716,495 | A | | 8/1955 | Prevette et al. |
| 2,852,143 | A | | 9/1958 | Taber |
| 2,935,205 | A | | 5/1960 | Higgin |
| 3,161,158 | A | | 12/1964 | Lurey |
| 3,276,400 | A | * | 10/1966 | Brunette |
| 3,612,288 | A | | 10/1971 | Lesley |
| 3,640,389 | A | | 2/1972 | Snyder |
| 3,692,189 | A | * | 9/1972 | Preston |
| 4,193,351 | A | | 3/1980 | Belokin, Jr. |
| 4,260,072 | A | * | 4/1981 | Quasarano |
| 4,299,327 | A | * | 11/1981 | Thauer ..... 211/186 |
| 4,377,241 | A | * | 3/1983 | Schreiner ..... 108/55.1 X |
| 4,646,922 | A | | 3/1987 | Smith |
| 4,750,623 | A | | 6/1988 | Flum |
| 4,785,946 | A | | 11/1988 | Sorenson |
| 4,919,282 | A | * | 4/1990 | Duff et al. ..... 211/187 X |
| 5,233,931 | A | * | 8/1993 | McCorkle ..... 108/55.1 |
| 5,272,991 | A | | 12/1993 | Carrigan, Jr. |
| 5,277,486 | A | | 1/1994 | Bustos |
| D376,889 | S | * | 12/1996 | Pilla |
| 5,871,108 | A | | 2/1999 | White |
| 5,921,011 | A | | 7/1999 | Hawver |
| 6,073,786 | A | * | 6/2000 | McCorkle ..... 211/187 |
| 6,158,600 | A | * | 12/2000 | Ferrucci et al. ..... 211/187 X |
| 6,244,194 | B1 | * | 6/2001 | Salmanson et al. ..... 108/55.1 |

* cited by examiner

*Primary Examiner*—Robert W. Gibson, Jr.
(74) *Attorney, Agent, or Firm*—Banner & Witcoff, Ltd.

(57) ABSTRACT

A rack merchandising system comprising a movable pallet base having openings to receive lifting forks, and a central support structure, the central support structure perpendicularly attached to the moveable pallet base and having two vertically extending sides. The central support structure may also comprise at least one transverse support member extending between the two vertically extending sides. The system further has at least two vertical upright supports that are spaced apart from each other and are located at or near a peripheral edge of a top surface of the movable pallet base, each vertically extending side being aligned with one of the vertical upright supports. The system further has at least one inclined shelf having a first side, a second side, a third side, and a fourth side, the first side and the fourth sides being parallel to each other and perpendicular to the second and third sides. The system further comprises a first attachment means for attaching the shelf to the central support structure, wherein the central support structure supports the shelf at a first side of the shelf, and a second attachment means for attaching the shelf to the vertical upright supports at the second and third sides of the shelf respectively, wherein the vertical upright supports support the shelf at the second and third sides of the shelf, and wherein the first attachment means is vertically higher than the second attachment means.

25 Claims, 8 Drawing Sheets

FIG.3A
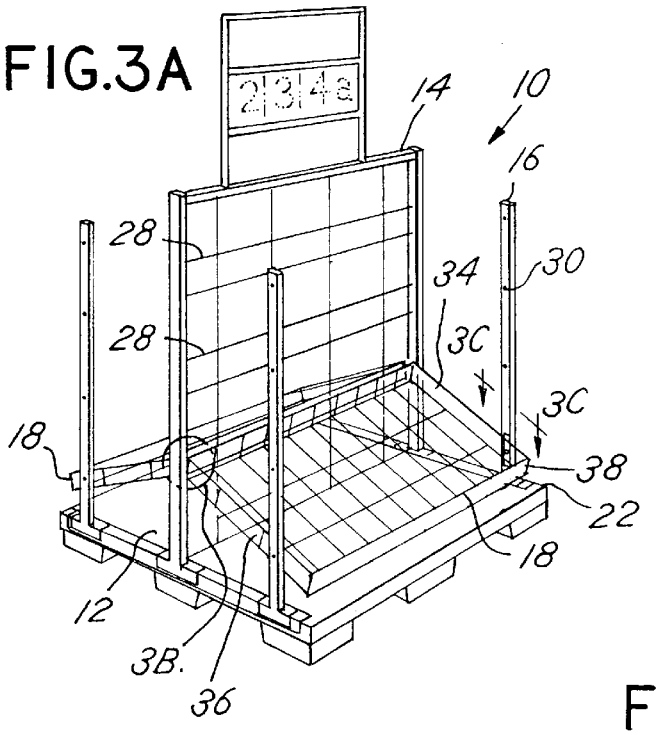
FIG.3C
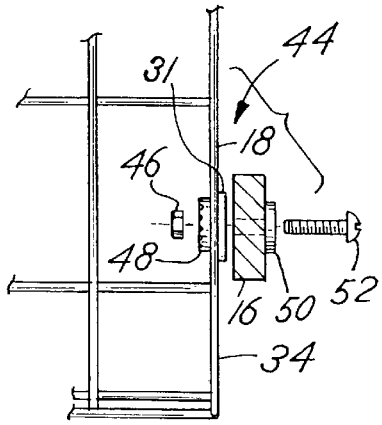
FIG.3B
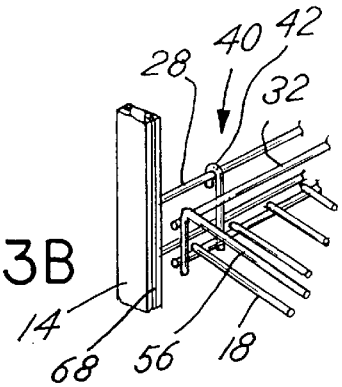
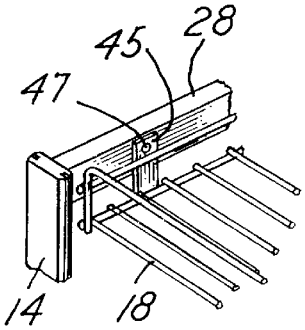
FIG.4B
FIG.4A
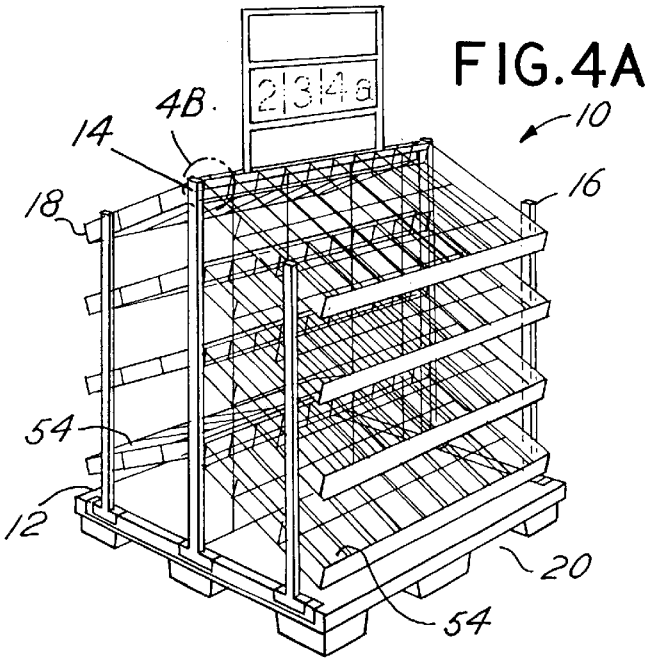

RACK MERCHANDISING SYSTEM

FIELD OF THE INVENTION

The invention relates to rack merchandising systems.

BACKGROUND OF THE INVENTION

Retail store locations, such as grocery stores, drug stores, discount stores, and convenience stores, typically use shelving both to store and display items, such as bottled or canned beverages, to consumers. It is preferable that shelving be easy to install and capable of organizing and displaying a large number of items that collectively comprise heavy merchandise loads. To satisfy these requirements, many retail store locations use gondola-shelving systems. Gondola shelving systems typically employ shelves that are supported by brackets, and hook formations of the brackets are inserted into a support, such as conventional slotted uprights. These systems are typically assembled, installed, and stocked with retail items at fixed locations within a store, such as along a store aisle.

To maximize retail store sales, retail stores typically run seasonal and/or other promotions involving certain retail items, and it is desirable during these promotions to provide shelving systems to display those items at high traffic store locations, e.g., near cash registers and/or near the end of a store aisle. Conventional shelving systems that have been assembled, installed and stocked with product at one store location are not thereafter typically moved to a higher traffic store location to display the items during certain seasonal and/or other promotions. The reason conventional systems stocked with items are not typically moved to another store location is that they bear a heavy merchandise load and do not provide suitable structure to permit easy movement of the stocked shelving systems using conventional pallet jacks or fork lifts.

It would be desirable to provide a rack merchandising system that is readily, conveniently, and easily assembled and that, after being stocked with product, can be readily, conveniently, and easily moved to different store locations, e.g., as may be desired for various promotions.

SUMMARY OF THE INVENTION

The present invention provides a rack merchandising system having suitable structure to permit movement of the stocked rack merchandising system using a conventional pallet jack or forklift. The present invention is a rack merchandising system comprising a movable pallet base, a central support structure, at least two vertical upright supports, and at least one inclined shelf. The movable pallet base has openings to receive the forks of a forklift (not shown) or otherwise be lifted by a pallet jack (not shown). The vertical upright supports are preferably spaced apart from each other and are located at or near the outer peripheral edge of the top surface of the movable pallet base. The central support structure comprises two vertically extending sides, each extending side being spaced apart from and aligned with one of the vertical upright supports. The central support structure is perpendicularly attached to the base. The central support structure may also comprise at least one transverse support member that extends between the two vertically extending sides. Each central support structure in combination with the shelf has a first attachment means for attaching the shelf to the central support structure wherein the central support structure supports the shelf. Each vertical upright support in combination with the shelf has a second attachment means for attaching the shelf to the vertical upright support wherein the vertical upright support supports the shelf.

The shelf has a first, second, third, and fourth sides. The first and fourth sides of the shelf are parallel to each other and perpendicular to the second and third sides of the shelf. The shelf can be attached to the central support structure at or near the first side. In addition, the shelf can be attached to the vertical upright supports at or near its second, and third, and or fourth sides. When the shelf is installed in the rack merchandising system, the first side of the shelf is attached to the central support structure at a point vertically higher than the point where the shelf is attached to the vertical upright supports. Thus, the shelf can have a forwardly inclined orientation so that when an item is taken off the shelf, the items behind the removed item slide towards the front of the shelf. Preferably, the shelf can be removed and replaced as may be desired to facilitate the merchandising of multiple bottled and/or canned beverages of various types and sizes. Preferably, the shelves are divided into channels, each channel allowing a column of beverage containers to be stocked. Preferably, the floor of the channel is lined with a slippery or friction resistant material to allow beverage bottles to slide to their forward-most position for increased presentation to and easier access by customers.

The present invention can further include a variety of advertising graphics. For example, advertising graphics can be placed on top of the central support structure and not be obstructed from view by merchandise on the top shelf. In addition, advertising graphics can be placed on the "C" shaped channel strips on the front of the inclined shelves. Advertising graphics can also be placed on vertically extending side panels located on the sides of the rack merchandising system and attached to the movable pallet base.

Further objects, features and advantages of the present invention will become apparent from the following drawings and detailed description. The following drawings and detailed description afford a comprehensive understanding of the present invention. However, it should be understood that the described preferred embodiments are illustrative only, since various modifications within the spirit and scope of the invention may become apparent to those of ordinary skill in the art who have benefited from this disclosure.

BRIEF DESCRIPTION OF THE DRAWINGS

FIG. 3A is a perspective view of a preferred embodiment of FIG. 2, with two installed shelves 18.

FIG. 3B is an enlarged perspective view of a preferred first attachment means for attaching the shelf to the transverse support member 28.

FIG. 3C is an enlarged top view of a preferred second attachment means for attaching the shelf to the vertical upright supports.

FIG. 4A is a perspective view of a preferred embodiment of FIG. 3A, wherein eight shelves 18 are installed.

FIG. 4B is an enlarged perspective view of another preferred first attachment means for attaching the shelf to the transverse support member 28.

DETAILED DESCRIPTION OF PREFERRED EMBODIMENTS

Figure 1:
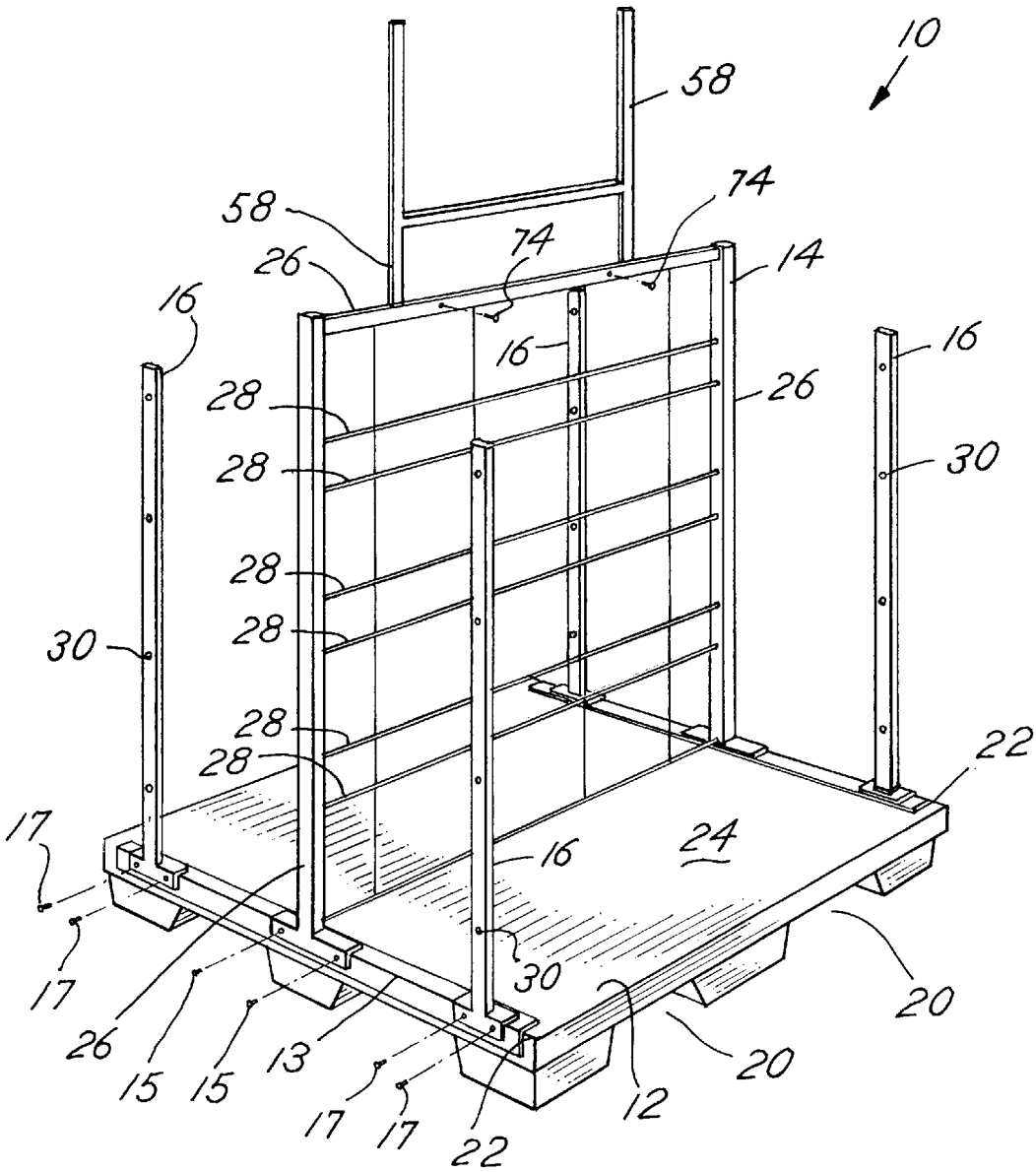
FIG. 1 is a perspective view of a preferred embodiment of the rack system of the present invention without removable shelves shown.
Figure 2:
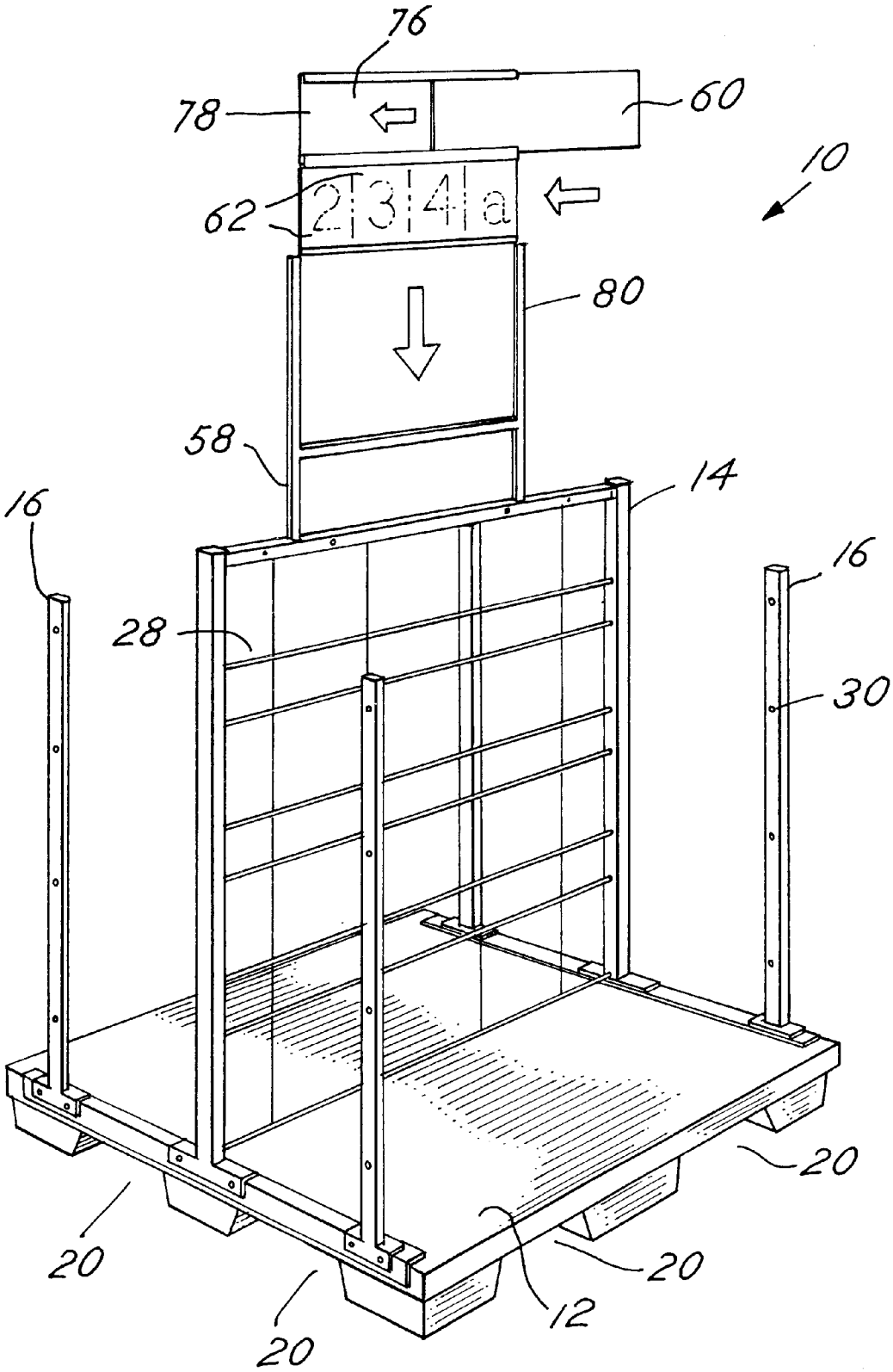
FIG. 2 is a perspective view of a preferred embodiment of FIG. 1, with advertising graphics.
Figure 5:
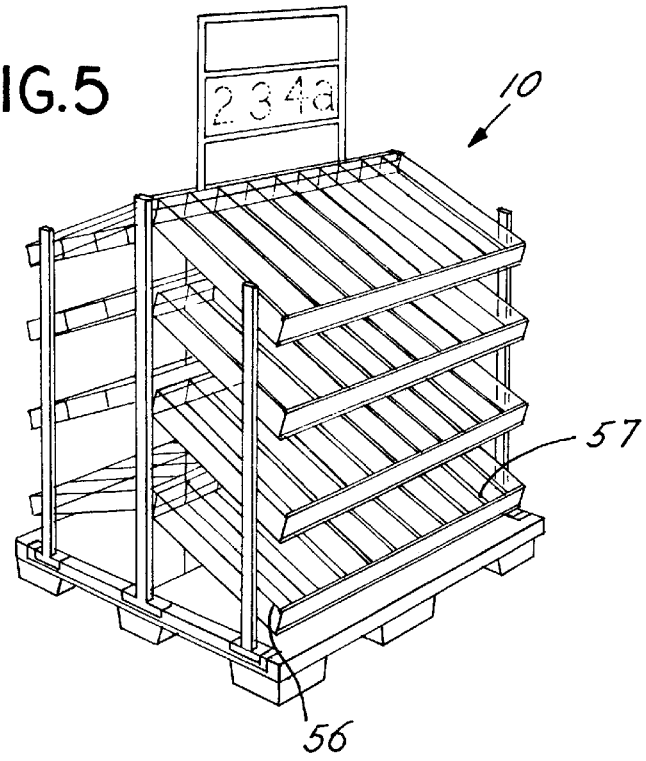
FIG. 5 is a perspective view of another preferred embodiment of the present invention.

As shown in FIGS. 1–11, the present invention is a rack merchandising system 10 comprising a movable pallet base 12, a central support structure 14, at least two vertical upright supports 16, and at least one inclined shelf 18. The movable pallet base 12 has openings 20 to receive the forks of a forklift (not shown) or otherwise be lifted by a pallet jack (not shown). The vertical upright supports 16 are preferably spaced apart from each other and are located at or near the outer peripheral edge 22 of the top surface 24 of the movable pallet base 12. The central support structure 14 comprises two vertically extending sides 26, each extending side being spaced apart from and aligned with one of the vertical upright supports 16. The central support structure 14 is perpendicularly attached to the pallet base 12. In an example of a preferred assembly, a brace 13, having holes that align with holes in the pallet base, can be placed on opposite ends of the movable pallet base 12, and the central support structure 14 can be attached to the pallet base 12 by screws or bolts 15 that are inserted into holes defined by the central support structure 14, the holes defined by the brace 13, and the holes defined by the pallet base. Screws or bolts 15 can be, for example, ½-20×1" hex head machine screws, and washers can also be used. The vertical upright supports can be attached to the pallet base 12 by screws or bolts 17. The central support structure may further comprise at least one transverse support member 28 that extends between the two vertically extending sides 26 of central support structure 14.

Each central support structure 14 in combination with the shelf 18 has a first attachment means 40 for attaching the shelf 18 to the central support structure 14 wherein the central support structure 14 supports the shelf 18. An example of a first attachment means 40 comprises a hook 42 as shown in FIG. 3B. As further shown in FIG. 3B, when central support structure 14 includes a transverse support member 28, transverse support member 28 in combination with shelf 18 has a first attachment means 40 for attaching the shelf 18 to the transverse support member 28 wherein the transverse support member 28 supports the shelf 18.

Each vertical upright support 16 in combination with the shelf 18 has a second attachment means 44 for attaching the shelf 18 to the vertical upright support 16 wherein the vertical upright support 16 supports the shelf 18. An example of a second attachment means 44 is a combination of a nut 46, a lock washer 48, a support bar 31, a washer 50, and a screw 52 as shown in FIG. 3C. Screw 52 is inserted through washer 50, hole 30 of vertical upright support 16, support bar 31, lock washer 48, and nut 46.

As shown in FIG. 4A, plurality of shelves 18 can be stacked in parallel on either or both sides of the central support structure 14. As shown in FIG. 4B, the top shelf 18 does not have hooks, and can be attached to the central support structure 14 with a bracket 45 and screw 47 combination. Screws 47 can be, for example, ¼-20×1½" hex head machine screws. Nuts and washers (not shown) can also be used in combination with the screws 47 and bracket 45.

The shelf has a first, second, third, and fourth sides, which are respectively identified in FIGS. 3A and 3B as 32, 34, 36, and 38. The first side 32 and the fourth side 38 of the shelf 18 are parallel to each other and perpendicular to the second side 34 and the third side 36 of the shelf 18. The shelf 18 can be attached to the transverse support member 28 at or near the first side 32. In addition, the shelf 18 can be attached to the vertical upright supports 16 at or near the second side 34, the third side 36, and/or the fourth side 38. When the shelf 18 is installed in the rack merchandising system 10, the first side 32 of the shelf 18 is attached to the transverse support member 28 at a point vertically higher than the point where the shelf 18 is attached to the vertical upright supports 16. Preferably, the shelf can be removed and replaced as may be desired to facilitate the merchandising of a plurality of items of various types and sizes, e.g., bottled beverages of various types and sizes. Preferably, the shelves 18 are divided into channels 54, each channel 54 allowing a column 72 of upright items 70 to be stocked. See e.g., FIG. 10. Shelves 18 can be comprised of wire 56 and/or slides 57. Slides 57 can be snapped into channels 54. For example, at the back of each slide 57 clips (not shown) can be positioned that snap around the two center wires defining each channel 54. In a preferred embodiment, the wire 56 and/or slide 57 is coated with a slippery or friction resistant material to allow the stored items to move to their forward-most position for increased presentation to and easier access by customers.

As shown in the drawings, the rack merchandising system 10 of the present invention can have a plurality of shelves 18. Further, shelves 18 can be positioned at various vertical locations on either side of the central support structure 14. Those of skill in the art will recognize that each shelf 18 can be moved to a desired angular orientation by pivoting the shelf 18 about the first attachment means 40 to move the fourth side 38 of shelf 18 to a desired vertical point and the second attachment means 44 is then used to fix the shelf 18 to the vertical upright supports 16. Those skilled in the art will also recognize that shelves 18 can be stacked in parallel at desired locations and angular orientations.

Figure 7:
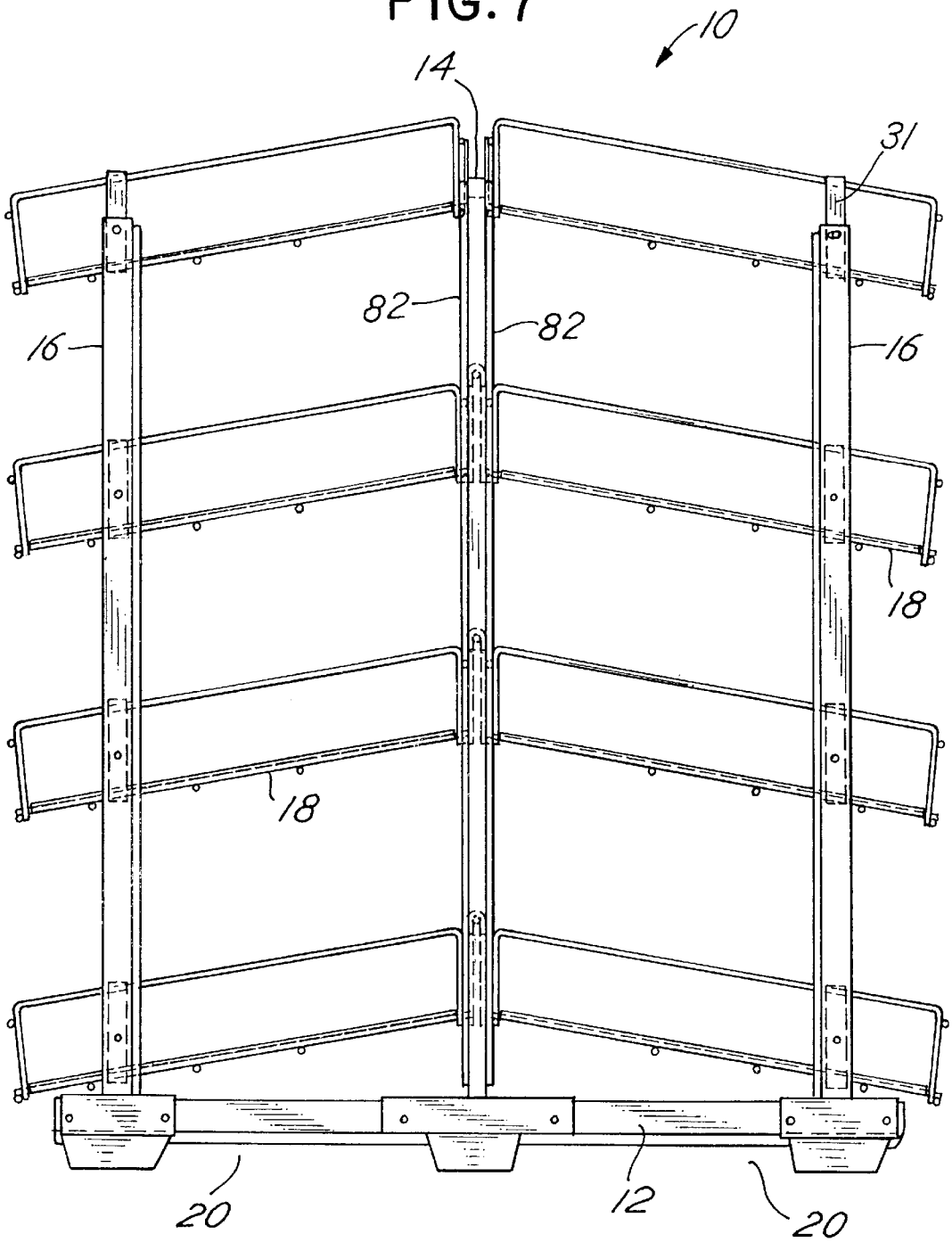
FIG. 7 is a side view of a preferred embodiment of the present invention.
Figure 8:
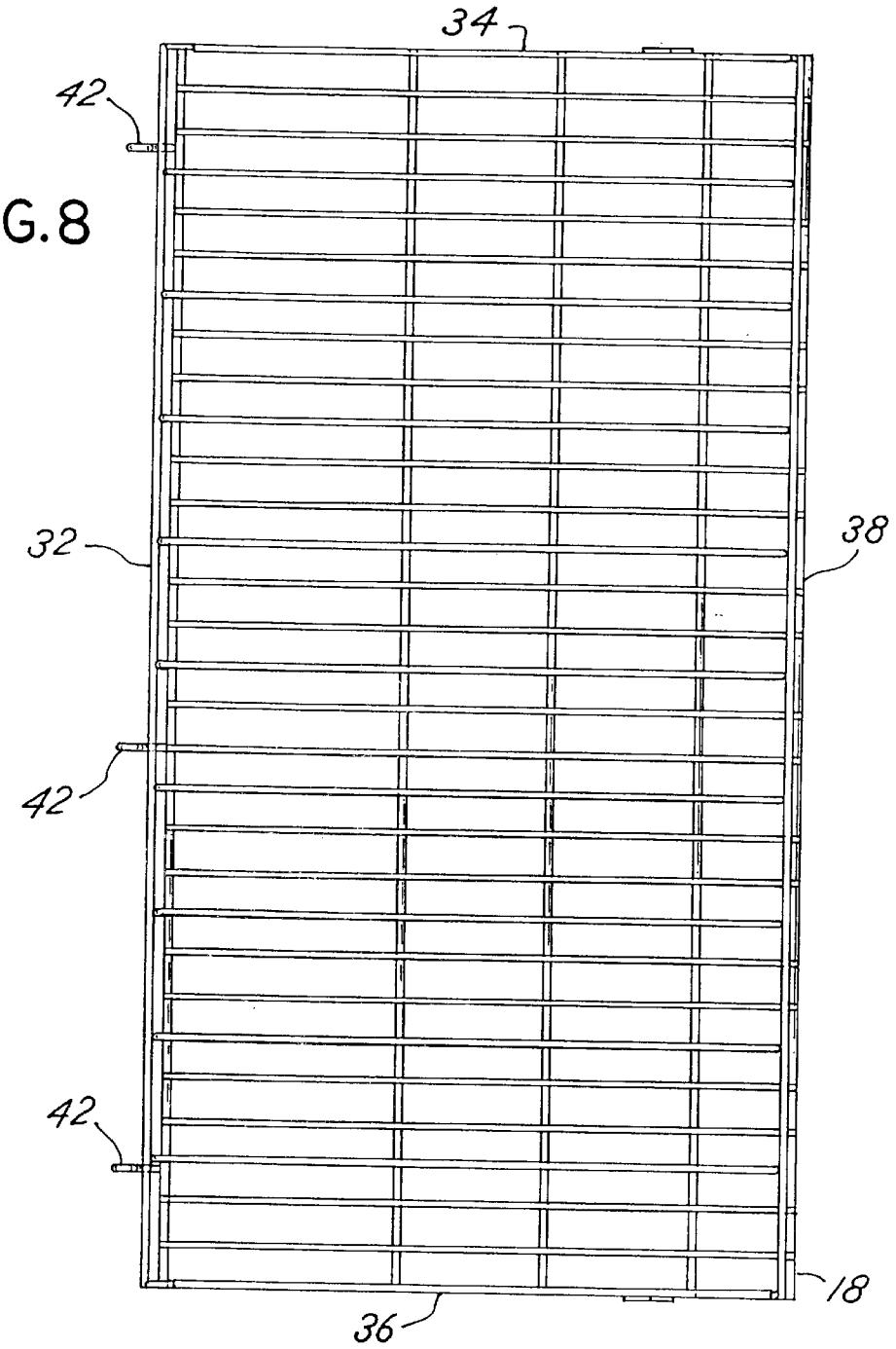
FIG. 8 is a top view of a shelf 18 of a preferred embodiment of the present invention.
Figure 9:
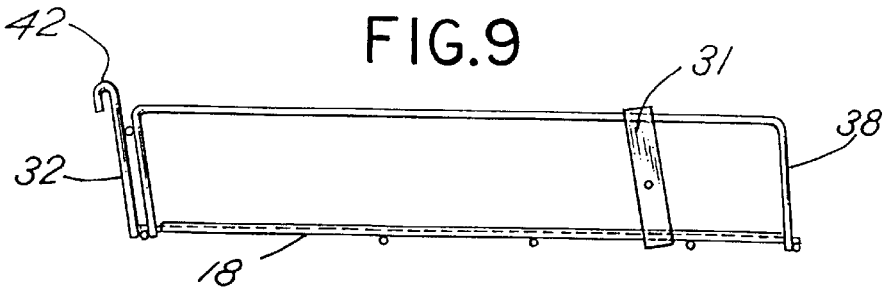
FIG. 9 is a side view of a shelf 18 of a preferred embodiment of the present invention.
Figure 10:
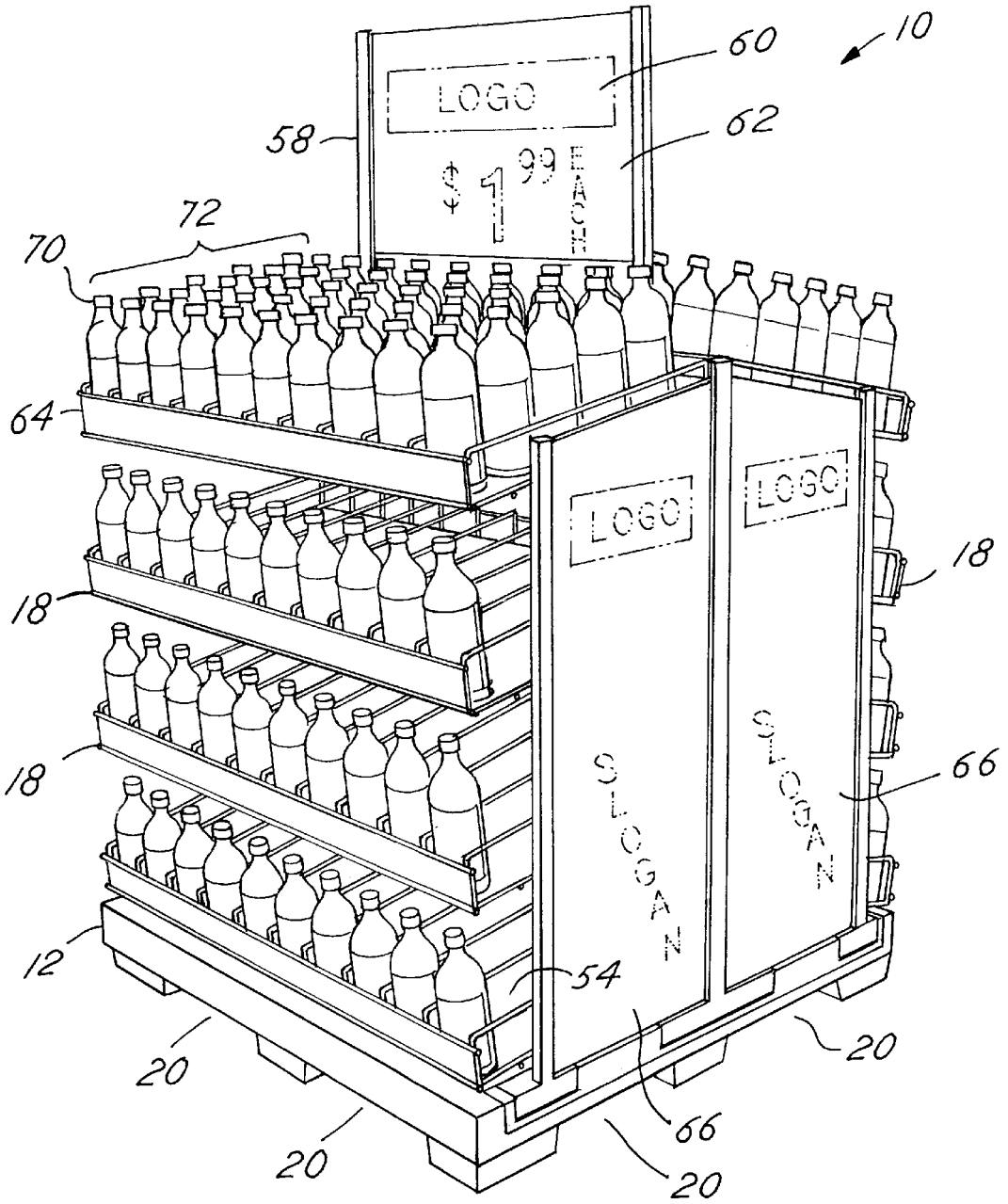
FIG. 10 is a perspective view of a preferred embodiment of the present invention that is stocked with items.
Figure 11:
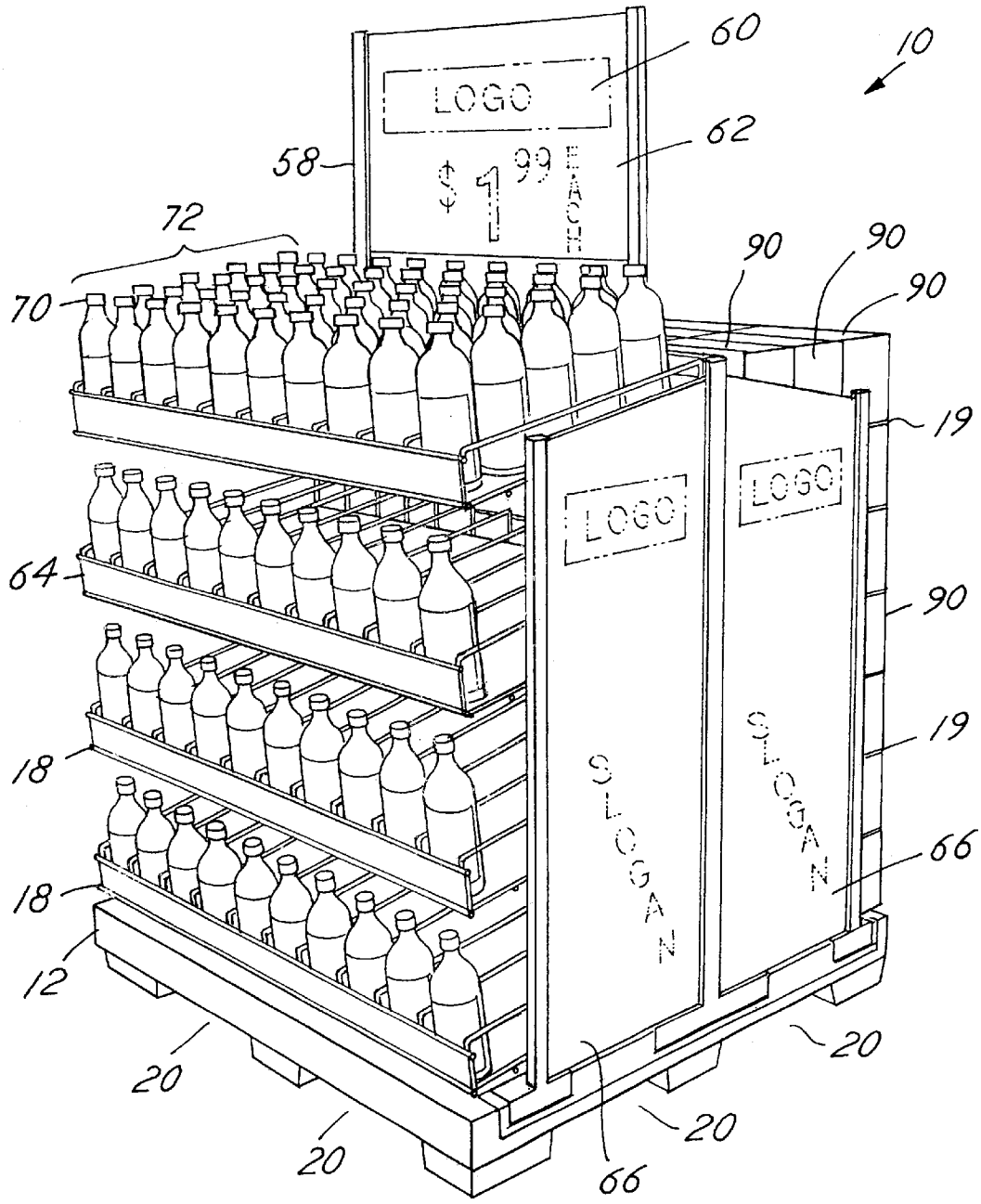
FIG. 11 is a perspective view of a preferred embodiment of the present invention that is stocked with items.

As shown in FIGS. 7 and 10, a plurality of inclined shelves 18 can be positioned on either oppositely facing front 82 of the central support structure 14. This arrangement is particularly desirable for storage and display of individual packages items 70, e.g., two-liter beverage bottles. Alternatively, as shown in FIG. 11, a plurality of inclined shelves 18 can be positioned on only one side of the central support structure and horizontal shelves 19 can positioned on the other side of the central support structure 14. Horizontal shelves 19 can be used when it is desirable to store and display relatively heavy packages of items, e.g., packages 90 of six, twelve or twenty-four beverage cans or bottles.

The present invention can further include a variety of advertising graphics. For example, advertising graphics 60 and/or flip charts 62 can be placed on a header 58 that is attached to the central support structure 14, and not be obstructed from view by merchandise on the top shelf 18. Advertising graphics 60 can be inserted into channel 76 defined by extrusion 78. See FIG. 2. Extrusion 78 can then be slid into channel 80 defined by header 58. The attachment of header 58 to the central support structure 14 can be made using screws or bolts 74. See FIG. 1. An example of screws or bolts 74 are ¼-20×2" hex head machine screws. Washers and nuts (not shown) can also be used to attach the header to the central support structure 14.

Figure 6:
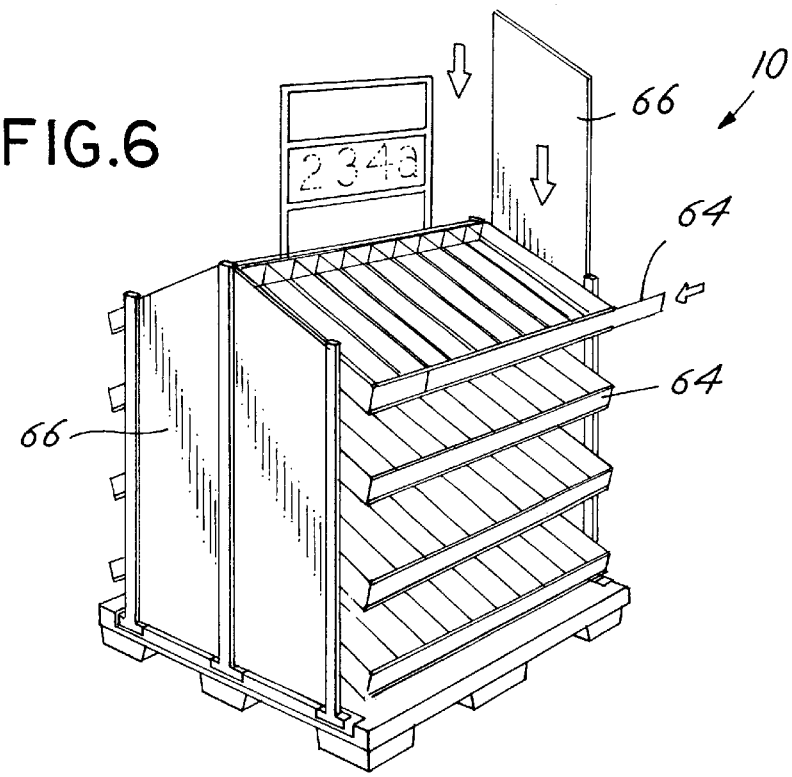
FIG. 6 is a perspective view of another preferred embodiment of the present invention.

In addition, advertising graphics can be placed on strips 64 on the fourth side 38 or front of the inclined shelves 18. Strips 64 can be slid into channels defined by the fourth side 38 or front of inclined shelves 18. Advertising graphics can also be placed on vertically extending side panels 66 located on the sides of the rack merchandising system 10. As shown in FIG. 6, side panels 66 can slide between channels 68 (shown in FIG. 3B) defined by vertically extending sides 26 and vertical upright supports 16.

The present invention has been described in detail with particular reference to certain preferred embodiments thereof, and those of skill in the art will appreciate that variations and modifications are within the spirit and scope of the present invention as set forth in the following claims.

I claim:

1. A rack merchandising system comprising a movable pallet base having openings to receive lifting forks, a central support structure, the central support structure perpendicularly attached to the moveable pallet base and having two vertically extending sides, at least two vertical upright supports that are spaced apart from each other and are located at or near a peripheral edge of a top surface of the movable pallet base, each vertically extending side being aligned with one of the vertical upright supports, at least one inclined shelf having a first side, a second side, a third side, and a fourth side, the first side and the fourth sides being parallel to each other and perpendicular to the second and third sides, a first attachment means for attaching the shelf to the central support structure, wherein the central support structure supports the shelf at a first side of the shelf, and a second attachment means for attaching the shelf to the vertical upright supports at the second and third sides of the shelf respectively, wherein the vertical upright supports support the shelf at the second and third sides of the shelf, the first attachment means being vertically higher than the second attachment means.

2. The rack merchandising system of claim 1, wherein the inclined shelf is divided into channels, each channel having dimensions to receive a series of retail items.

3. The rack merchandising system of claim 2, wherein the channels comprise wire.

4. The rack merchandising system of claim 2, wherein the channels comprise slides.

5. The rack merchandising system of claim 2, wherein each channel comprises a friction resistant material where a bottom of a stocked retail item comes in contact with the channel.

6. The rack merchandising system of claim 1, further comprising a plurality of inclined shelves.

7. The rack merchandising system of claim 1, wherein the first attachment means can be positioned at various vertical locations along the central support structure.

8. The rack merchandising system of claim 1, wherein the second attachment means can be positioned at various vertical locations along the vertical upright supports.

9. The rack merchandising system of claim 1, wherein the central support structure has two oppositely facing fronts, and the shelf can be positioned at various vertical locations on either front of the central support structure.

10. The rack merchandising system of claim 1, wherein the shelf pivots about the first attachment means to move the fourth side of the shelf to a desired vertical point to achieve a desired angular orientation of the shelf.

11. The rack merchandising system of claim 6, wherein the shelves are stacked in parallel.

12. The rack merchandising system of claim 9, wherein at least one inclined shelf is positioned at each front of the central support structure.

13. The rack merchandising system of claim 9, further having at least one inclined shelf at one front of the central support structure, and at least one non-inclined shelf at the opposite front of the central support structure.

14. The rack merchandising system of claim 9, wherein a plurality of inclined shelves are positioned at each front of the central support structure.

15. The rack merchandising system of claim 9, further having a plurality of inclined shelves at one front of the central support structure, and plurality of non-inclined shelves at the opposite front of the central support structure.

16. The rack merchandising system of claim 1, wherein the central support structure further comprises at least one transverse support member extending between the two vertically extending sides.

17. The rack merchandising system of claim 16, wherein the first attachment means attaches the shelf to the transverse support member of the central support structure.

18. The rack merchandising system of claim 6 further comprising signage for advertising graphics, the signage located on top of the central support structure and not obstructed from a customer's view by merchandise stored on the top shelf.

19. The rack merchandising system of claim 1 further comprising signage for advertising graphics, the signage located on at least one strip located on the fourth side of the shelf.

20. The merchandising system of claim 1 further comprising signage for advertising graphics, the signage located on at least one vertically extending side panel located on at least one vertically extending side of the rack merchandising system.

21. The merchandising system of claim 20 wherein the side panel is slid between a pair of channels defined by the central support structure and the vertical upright supports.

22. A rack merchandising system comprising a movable pallet base having openings to receive lifting forks, a central support structure, the central support structure perpendicularly attached to the moveable pallet base and having two vertically extending sides, at least two vertical upright supports that are spaced apart from each other and are located at or near a peripheral edge of a top surface of the movable pallet base, each vertically extending side being aligned with one of the vertical upright supports, at least one inclined shelf having a first side, a second side, a third side, and a fourth side, the first side and the fourth sides being parallel to each other and perpendicular to the second and third sides, at least one hook to attach the shelf to the central support structure, wherein the central support structure supports the shelf at a first side of the shelf, and a pair of nuts and screws to attach the shelf to the vertical upright supports at the second and third sides of the shelf respectively, wherein the vertical upright supports support the shelf at the second and third sides of the shelf, the hook being vertically higher than the nuts and screws.

23. The rack merchandising system of claim 22, the shelf is divided into channels, each channel allowing a column of upright retail items to be stocked.

24. The rack merchandising system of claim 22, wherein the central support structure further comprises at least one transverse support member extending between the two vertically extending sides.

25. The rack merchandising system of claim 24, wherein the first attachment means attaches the shelf to the transverse support member of the central support structure.

* * * * *